US008033257B2

(12) United States Patent
Fischer

(10) Patent No.: US 8,033,257 B2
(45) Date of Patent: Oct. 11, 2011

(54) VANE-TYPE CAM PHASER HAVING STAGED LOCKING PINS TO ASSIST INTERMEDIATE POSITION LOCKING

(75) Inventor: Thomas H. Fischer, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 341 days.

(21) Appl. No.: 12/150,381

(22) Filed: Apr. 28, 2008

(65) Prior Publication Data

US 2009/0266322 A1 Oct. 29, 2009

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 6,779,499 | B2 | 8/2004 | Takenaka et al. | |
| 2003/0121485 | A1* | 7/2003 | Strauss | 123/90.17 |
| 2005/0284432 | A1* | 12/2005 | Tsukada | 123/90.17 |
| 2007/0277758 | A1 | 12/2007 | Fishcer | |

* cited by examiner

*Primary Examiner* — Zelalem Eshete
(74) *Attorney, Agent, or Firm* — Thomas N. Twomey

(57) ABSTRACT

A vane-type camshaft phaser including a bias spring to urge the rotor toward an intermediate locking position from any rotational position retarded of the locking position. The rotor comprises non-coaxially acting primary and secondary locking pins for mating with primary and secondary locking pin seats in the phaser stator. The primary seat is elongated and is readily located by the primary locking pin to provide a first limit to the rotor phase angle authority in the retard direction. Camshaft torque reversals cause the rotor phase angle to dither. With each torque reversal the secondary locking pin passes over its seat, allowing multiple opportunities for re-engagement. The clearance of the secondary locking pin to its seat defines the rotary lash in the phaser.

7 Claims, 3 Drawing Sheets

VANE-TYPE CAM PHASER HAVING STAGED LOCKING PINS TO ASSIST INTERMEDIATE POSITION LOCKING

TECHNICAL FIELD

The present invention relates to vane-type camshaft phasers for varying the phase relationship between crankshafts and camshafts in internal combustion engines; more particularly, to such phasers wherein a locking pin is utilized to lock the phaser rotor with respect to the stator at certain times in the operating cycle; and most particularly, to a phaser having staged locking pins to reliably lock a phaser rotor at a rotational position intermediate between full timing advance and full timing retard positions.

BACKGROUND OF THE INVENTION

In a typical prior art vane-type cam phaser, a controllably selective locking pin is slidingly disposed in a bore in a rotor vane to permit rotational locking of the rotor to the stator (or sprocket wheel or pulley) under certain conditions of operation of the phaser and engine. In older prior art phasers, it is desired that the rotor be locked at an extreme of the rotor authority, typically at the full retard position. In other prior art phasers, it is desired that the rotor be lockable to the stator at an intermediate position in an increased rotor range of rotational authority.

A known problem in such phasers is that there is no mechanical means such as a stop to assist in positioning the rotor for locking in an intermediate position; thus, locking is not reliable.

Various approaches involving advance-direction bias springs are known in the art for assisting a rotor locking pin in finding and securing the intermediate locking position. It is known to employ dual locking pins acting in the same direction. See, for example, U.S. Pat. No. 6,779,499 B2. Manufacturing tolerances for such phasers make impractical the precise alignment of the locking pins and their respective seats for controlling lash using both locking pins. The rotary lash will be a function of the clearance between only one or the other, but not both, of the locking pins and seats. Therefore, a means must be found for providing opportunities for the lash-controlling locking pin to engage its seat.

What is needed in the art is an arrangement for reliably engaging a lash-controlling locking pin into its seat.

It is a principal object of the present invention to minimize rotational lash in a camshaft phaser.

SUMMARY OF THE INVENTION

Briefly described, a vane-type camshaft phaser in accordance with the invention for varying the timing of combustion valves in an internal combustion engine includes a pre-loaded bias spring to urge the rotor toward an intermediate locking position from any rotational position retarded of the locking position. The rotor comprises a primary locking pin and a secondary locking pin for mating with respective primary and secondary locking pin seats in the phaser stator, the first and second locking pins being non-coaxially acting. The primary seat is elongated and therefore is readily located by the primary locking pin to provide a first limit to the rotor phase angle authority in the retard direction when the camshaft torque is positive (in the phaser retard direction). With each valve event, as the valve closes the camshaft torque reverses, becoming momentarily negative and causing the phase angle to advance by a few degrees. The secondary locking seat is so positioned that with each torque reversal the secondary locking pin passes over the secondary seat, allowing for multiple opportunities for re-engagement of the secondary pin with its seat. The clearance of the secondary locking pin to its seat defines the rotary lash in the phaser. Therefore, the manufacturing tolerances for positional location of the primary locking pin and its seat are not critical, and manufacturing costs are thus substantially reduced.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
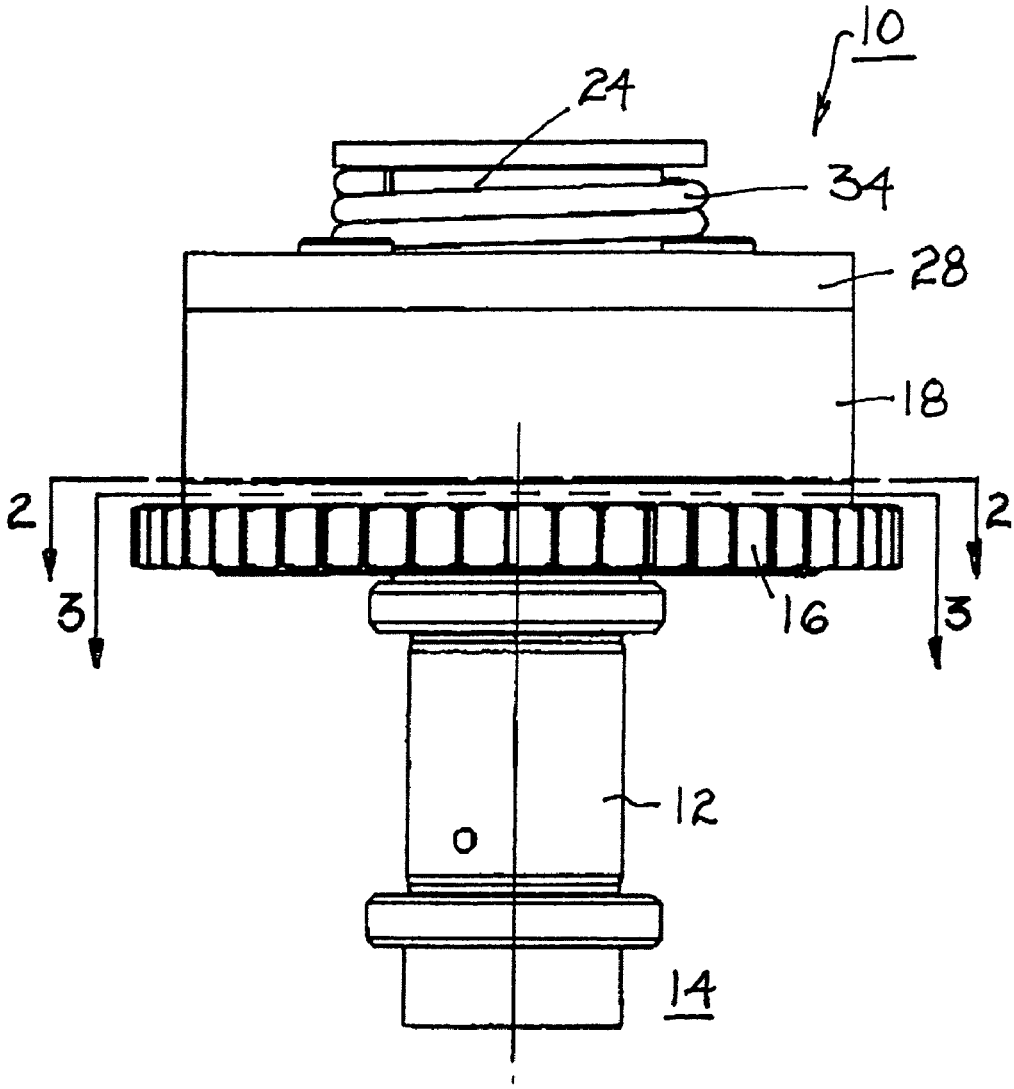
FIG. 1 is an elevational view of a vane-type camshaft phaser in accordance with the present invention.
Figure 2:
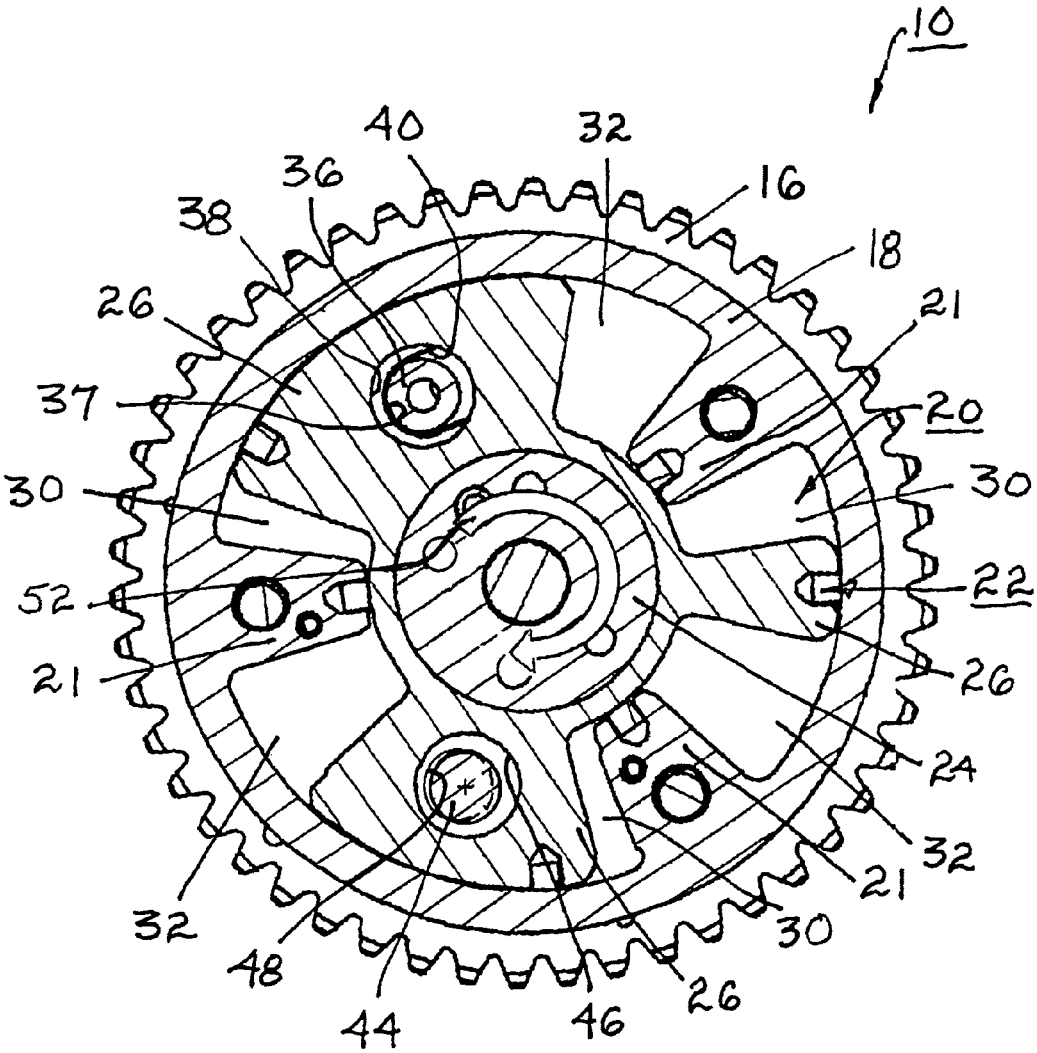
FIG. 2 is a cross-sectional view taken along line 2-2 in FIG. 1.

Referring to FIGS. 1 and 2, a vane-type camshaft phaser 10 in accordance with the present invention is shown as mounted on the end of a camshaft 12 of an internal combustion engine 14. Phaser 10 includes a pulley or sprocket 16 for engaging a timing chain or belt (not shown) operated by an engine crankshaft (not shown). A stator 18 is disposed against pulley/sprocket 16 and is rotationally immobilized with respect to pulley/sprocket 16 (and may be formed integral therewith). Stator 18 is provided with a central chamber 20, subdivided by a plurality of inwardly-extending spaced-apart lobes 21, for receiving a rotor 22 having a hub 24 and a plurality of spaced-apart vanes 26 extending radially therefrom. Central chamber 20 is closed by a cover plate 28, forming advance and retard chambers 30,32 between the rotor and the stator. A torsional bias spring 34 is mounted on hub 24 and grounded at a first end thereto and at a second end to cover plate 28, which is bolted to stator 18. Spring 34, as disclosed in currently pending U.S. patent application Ser. No. 11/639,530, published Dec. 6, 2007 as 2007/0277758 and incorporated herein by reference, is disposed to urge rotor 22 in a timing-advance direction from a fully retarded position in the rotor range of authority, for example, to about 6° from its fully retarded position.

Figure 3:
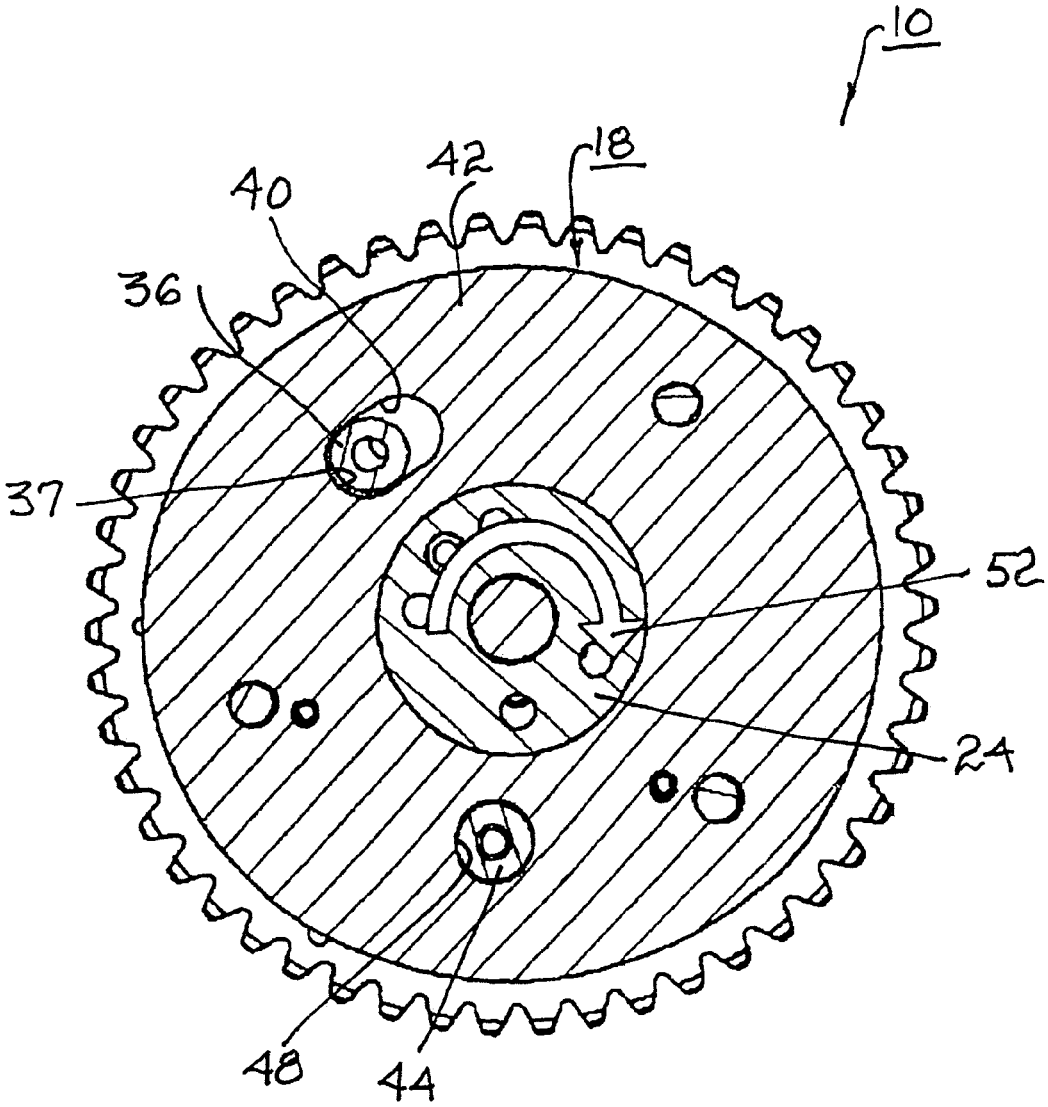
FIG. 3 is a cross-sectional view taken along line 3-3 in FIG. 1.

Referring now to FIGS. 2 and 3, a staged dual locking pin system is disclosed. Primary locking pin 36 is disposed in a first bore 38 in a rotor vane 26 for engaging a primary seat 40 formed in a wall 42 of stator 18. (Note: primary locking pin 36 is a stepped pin and is full-fitting in first bore 38 above cross-sectional view 2-2.) Primary seat 40 is arcuately slotted over an angular range of authority of rotor 22 of about 10° or more covering both sides of an intended intermediate lock position such that, in a first locking step, primary pin 36 finds easy and reliable seating into primary seat 40.

A similarly-stepped secondary locking pin 44 is disposed in a second bore 46 in a rotor vane 26, which may be the same as or different from the vane 26 hosting primary pin 36, for engaging a secondary seat 48 formed in wall 42. After such secondary locking, secondary pin 44 is substantially close-fitting within secondary seat 48, the clearance therewithin thus defining the rotational lash in phaser 10.

The purpose of primary pin 36 and primary pin seat 40 is to arrest rotor 22 within a narrow range of authority encompassing the locking location of secondary pin 44. In a presently preferred arrangement, once primary locking pin 36 is engaged in its slotted seat, the rotor's angular position may be dithered by subsequent camshaft torque reversals to allow secondary pin 44 to reliably engage secondary seat 48. As shown in FIG. 2, before secondary pin 44 is seated, torsional bias spring 34 urges rotor 22 in a timing-advance direction from a fully retarded position to about 6° from its fully retarded position. A camshaft torque reversal 52 causes rotor 22 to advance, in a timing advance direction, a few additional degrees (for example 4°) permitting primary pin 36 to enter slotted primary seat 40 against an end wall 37 of primary seat 40. At that point, secondary pin 44 is slightly misaligned with secondary seat 48 but positioned such that, in a second locking step, a slight advance of rotor 22 occasioned by a camshaft torque reversal 52 (FIG. 3) causes secondary pin 44 to align with secondary seat 48 and to lock therein. Note that this torque reversal also brings primary pin 36 off end wall 37.

In operation, it is desirable that the locking pins be engaged at the intermediate locking position for engine starting. The primary and secondary locking pins are seated by internal springs (not visible) in known fashion and are unlocked by pressurized oil supplied by the engine. If the rotor has been left in an unlocked and fully retarded position at the end of previous engine operation, bias spring 34 will advance the rotor part way toward the locking positions, for example, about 4°. As the engine is cranked, camshaft negative torque 50 in resisting the first valve closing will further advance the rotor the rest of the way, for example, about another 6°, to where the primary locking pin 36 can engage the slotted primary seat 40 but the secondary locking pin 44 cannot yet engage the secondary seat 48, as shown in FIG. 2. Thus the rotor is loosely locked at an intermediate location within its range of authority. The subsequent first camshaft torque reversal 52 cannot cause the rotor to be retarded because the primary pin is locked. From this position, the next valve event and accompanying negative torque pulse 52 causes rotor 22 to rotate about another 6°, causing the secondary pin 44 to pass over its seat 48. Successive valve events will cause the secondary pin to dither back and forth over the seat until the secondary pin extends into the seat and locks the rotor to the stator. Typically, such engagement occurs within one or two torque reversal cycles. As noted above, the sole purpose of the primary locking pin and seat is to position the secondary lash-limiting secondary pin in the immediate vicinity of the secondary seat such that normal rotor lash caused by normal torque fluctuations will cause the secondary pin to be dithered over the secondary seat.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A camshaft phaser for varying the phase relationship between a camshaft and a crankshaft in an internal combustion engine, comprising:

a) a stator having a plurality of inwardly-extending spaced-apart lobes;

b) a rotor rotatably disposed within said stator, said rotor having a plurality of outwardly-extending spaced-apart vanes disposed between said lobes and defining a plurality of advance and retard chambers within said stator wherein one of said rotor or said stator includes an elongated primary locking seat extending over an intermediate portion of an angular range of authority of said phaser, and one of said rotor or said stator includes a secondary locking seat defining an intermediate lock position such that said intermediate portion covers both sides of said intermediate lock position;

c) a bias spring for urging said rotor relative to said stator in a first direction;

d) a primary locking pin slidably disposed in a first bore in one of said rotor or said stator for selectively engaging said primary locking seat; and e) a secondary locking pin slidably disposed in a second bore in a one of said rotor or said stator for selectively engaging said secondary locking seat, wherein said primary locking seat is positioned such that a combination of torque from said bias spring and a first torque pulse from said camshaft in said first direction causes said primary locking pin to be positioned to engage said primary locking seat, and wherein said secondary locking seat is positioned such that an additional torque pulse from said camshaft in said first direction causes said secondary locking pin to be positioned to engage said secondary locking seat.

2. A phaser in accordance with claim 1 wherein said primary and secondary locking seats are formed in an end wall of said stator.

3. A phaser in accordance with claim 1 wherein said intermediate portion of said angular range extends over about ten degrees of angular rotor authority.

4. A phaser in accordance with claim 3 wherein an end of said primary locking seat is positioned at about ten degrees of angular rotor authority from a full-retard position.

5. A phaser in accordance with claim 1 wherein said primary locking pin and said secondary locking pin are disposed in different ones of said plurality of vanes.

6. An internal combustion engine comprising a camshaft phaser for advancing and retarding the timing of valves, wherein said camshaft phaser includes a stator having a plurality of inwardly-extending spaced-apart lobes, a rotor rotatably disposed within said stator, said rotor having a plurality of outwardly-extending spaced-apart vanes disposed between said lobes and defining a plurality of advance and retard chambers within said stator wherein one of said rotor or said stator includes an elongated primary locking seat extending over an intermediate portion of an angular range of authority of said phaser, and one of said rotor or said stator includes a secondary locking seat defining an intermediate lock position such that said intermediate portion covers both sides of said intermediate lock position, a bias spring for urging said rotor relative to said stator in a first direction, a primary locking pin slidably disposed in a first bore in a one of said rotor or said stator for selectively engaging said primary locking seat, and a secondary locking pin slidably disposed in a second bore in a one of said rotor or said stator for selectively engaging said secondary locking seat, wherein said primary locking seat is positioned such that a combination of torque from said bias spring and a first torque pulse from said camshaft in said first direction causes said primary locking pin to be positioned to engage said primary locking seat, and wherein said secondary locking seat is positioned such that an additional torque pulse from said camshaft in said first direction causes said secondary locking pin to be positioned to engage said secondary locking seat.

7. A camshaft phaser for varying the phase relationship between a camshaft and a crankshaft in an internal combustion engine, comprising:

a stator having a plurality of inwardly-extending spaced-apart lobes;

a rotor rotatably disposed within said stator, said rotor having a plurality of outwardly-extending spaced-apart vanes disposed between said lobes and defining a plurality of advance and retard chambers within said stator wherein one of said rotor or said stator includes an elongated primary locking seat extending over an intermediate portion of an angular range of authority of said phaser, and one of said rotor or said stator includes a secondary locking seat;

a bias spring for urging said rotor relative to said stator in a first direction;

a primary locking pin slidably disposed in a first bore in one of said rotor or said stator for selectively engaging said primary locking seat; and a secondary locking pin slidably disposed in a second bore in a one of said rotor or said stator for selectively engaging said secondary locking seat, wherein engagement of said secondary locking pin with said secondary locking seat provides clearance between said primary locking pin and said primary locking seat in both directions of rotor rotation.

* * * * *